US009316063B2

(12) United States Patent
Gonzalez et al.

(10) Patent No.: US 9,316,063 B2
(45) **Date of Patent: *Apr. 19, 2016**

(54) TRANSMITTING POWER WITHIN A WELLBORE

(71) Applicants: Manuel Eduardo Gonzalez, Houston, TX (US); Melvin Clark Thompson, Los Alamos, NM (US); Jacobo Archuleta, Santa Fe, NM (US); Patrick Rodriguez, Santa Fe, NM (US); David William Beck, Santa Fe, NM (US); Scot Ellis, Houston, TX (US); Wade Ogg, Bakersfield, CA (US)

(72) Inventors: Manuel Eduardo Gonzalez, Houston, TX (US); Melvin Clark Thompson, Los Alamos, NM (US); Jacobo Archuleta, Santa Fe, NM (US); Patrick Rodriguez, Santa Fe, NM (US); David William Beck, Santa Fe, NM (US); Scot Ellis, Houston, TX (US); Wade Ogg, Bakersfield, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/110,915

(22) PCT Filed: Mar. 14, 2013

(86) PCT No.: PCT/US2013/031526

§ 371 (c)(1),
(2) Date: Oct. 9, 2013

(87) PCT Pub. No.: WO2014/084889

PCT Pub. Date: Jun. 5, 2014

(65) Prior Publication Data

US 2015/0252625 A1 Sep. 10, 2015

Related U.S. Application Data

(60) Provisional application No. 61/731,332, filed on Nov. 29, 2012.

(51) Int. Cl.
*E21B 17/00* (2006.01)
*E21B 43/12* (2006.01)
*E21B 17/02* (2006.01)

(52) U.S. Cl.
CPC ..... *E21B 17/003* (2013.01); *E21B 17/028* (2013.01); *E21B 43/128* (2013.01)

(58) Field of Classification Search
CPC ... E21B 34/066; E21B 17/003; E21B 17/028; E21B 47/12; E21B 17/206; E21B 43/128
See application file for complete search history.

(56) References Cited

U.S. PATENT DOCUMENTS 4,308,499 A 12/1981 Thierbach et al.
4,981,173 A 1/1991 Perkins (Continued)

FOREIGN PATENT DOCUMENTS

EP 0721053 7/1996
EP 1193368 4/2002

(Continued)

OTHER PUBLICATIONS

International Search Report, mailed Dec. 18, 2014 for PCT/US2014/056385.

(Continued)

*Primary Examiner* — Daniel P Stephenson
(74) *Attorney, Agent, or Firm* — King & Spalding LLP

(57) ABSTRACT

A system for applying power into a wellbore. The system can include a casing, a tubing string, a first and second isolator sub, a power source, and an electrical device. The casing has a first cavity running therethrough. The tubing string is disposed within the first cavity without contacting the casing, where the tubing string has a second cavity running therethrough. The first isolator sub is mechanically coupled to the tubing string and positioned between the neutral section and the power-transmitting section of the tubing string. The power source is electrically coupled to the power-transmitting section of the tubing string below the first isolator sub. The second isolator sub is mechanically coupled to the tubing string and positioned between the bottom neutral section and the power-transmitting section of the tubing string. The electrical device is electrically coupled to a bottom end of the power-transmitting section of the tubing string.

19 Claims, 4 Drawing Sheets

(56) References Cited

U.S. PATENT DOCUMENTS

| | | | | |
|---|---|---|---|---|
| 4,987,684 | A * | 1/1991 | Andreas | G01C 21/16 33/304 |
| 5,745,047 | A * | 4/1998 | Van Gisbergen | E21B 17/003 340/853.1 |
| 6,633,236 | B2 | 10/2003 | Vinegar et al. | |
| 6,766,141 | B1 | 7/2004 | Briles et al. | |
| 7,158,049 | B2 | 1/2007 | Hoefel et al. | |
| 7,882,892 | B2 * | 2/2011 | Svenning | E21B 47/122 166/65.1 |
| 8,575,936 | B2 * | 11/2013 | Bloys | E21B 47/06 324/338 |
| 8,857,522 | B2 * | 10/2014 | Arrazola | E21B 34/10 166/363 |
| 9,103,198 | B2 * | 8/2015 | Gonzalez | E21B 47/122 |
| 2002/0126021 | A1 | 9/2002 | Vinegar | |
| 2003/0047317 | A1 | 3/2003 | Powers | |
| 2005/0051334 | A1 | 3/2005 | Baugh | |
| 2007/0235184 | A1 | 10/2007 | Thompson et al. | |
| 2008/0253230 | A1 | 10/2008 | Thompson et al. | |
| 2009/0159361 | A1 | 6/2009 | Coates et al. | |
| 2009/0174409 | A1 | 7/2009 | Coates et al. | |
| 2011/0037004 | A1 | 2/2011 | Lake | |
| 2011/0186303 | A1 * | 8/2011 | Scott | E21B 34/08 166/373 |

FOREIGN PATENT DOCUMENTS

| | | |
|---|---|---|
| GB | 2076039 | 11/1981 |
| GB | 2330598 | 4/1999 |
| GB | 2461065 | 12/2009 |
| WO | WO 80/00727 | 4/1980 |
| WO | WO 82/02754 | 8/1982 |
| WO | WO 97/16751 | 5/1997 |
| WO | WO 01/65061 | 9/2001 |

OTHER PUBLICATIONS

International Search Report for PCT/US2013/031526 mailed May 7, 2014.

International Search Report for PCT/US2011/060454 mailed Jan. 22, 2014.

* cited by examiner

TRANSMITTING POWER WITHIN A WELLBORE

CROSS-REFERENCE TO RELATED APPLICATIONS

This application is a national phase application of and claims priority of PCT Patent Application No. PCT/US2013/31526, titled "Transmitting Power Within A Wellbore" and filed on Mar. 14, 2013, which claims priority under 35 U.S.C. §119 to U.S. Provisional Patent Application Ser. No. 61/731,332, titled "Method, System and Apparatus for Transmitting Power into a Wellbore" and filed on Nov. 29, 2012. The entire contents of the foregoing applications are hereby incorporated herein by reference.

The present application also is related to U.S. patent application Ser. No. 13/295,784, titled "System and Method for Remote Sensing," and filed on Nov. 14, 2011; which claims priority to U.S. Provisional Patent Application Ser. No. 61/413,179, titled "System and Method for Remote Sensing," and filed on Nov. 12, 2010. The entire contents of the foregoing applications are hereby incorporated herein by reference.

TECHNICAL FIELD

The present disclosure relates generally to the application of electrical power into a subterranean wellbore.

BACKGROUND

In the production of oil and gas from a wellbore, it is sometimes necessary to employ pumps or other apparatus deep within the well for the purpose of pumping downhole fluids such as oil and gas vertically upwards for production from the wellbore. Such pumps use electrical power.

Subterranean wellbores may be drilled and constructed several miles below the ground or seabed. It is difficult or inconvenient to deliver electrical power to downhole equipment in such harsh environments. In some cases, electrical cables are installed in the wellbore, but such cables sometimes are difficult and expensive to install and maintain in an operationally secure manner. In addition, it can be difficult to install a cable in the confined space of a well for distances of several thousand feet, from the surface to downhole power consuming devices. Additionally, such cables may become eroded or damaged during installation or during use. Such damage may require costly workovers and delays in oil and gas production.

SUMMARY

In general, in one aspect, the disclosure relates to a system for applying power into a wellbore within a subterranean formation. The system can include a casing disposed within the wellbore and having a number of electrically conductive casing pipes mechanically coupled end-to-end, where the casing has a first cavity running therethrough. The system can also include a tubing string having a number of electrically conductive tubing pipes mechanically coupled end-to-end, where the tubing string is disposed within the first cavity without contacting the casing, where the tubing string has a top neutral section positioned proximate to an entry point of the wellbore, a bottom neutral section positioned toward a distal end of the wellbore, and a power-transmitting section positioned between the top neutral section and the bottom neutral section, and where the tubing string has a second cavity running therethrough. The system can further include a first isolator sub mechanically coupled to and positioned between the neutral section and the power-transmitting section of the tubing string, where the first isolator sub has the second cavity running therethrough, and where the first isolator sub electrically separates the casing from the tubing string and the top neutral section from the power-transmitting section. The system can also include a power source positioned above the entry point and electrically coupled to a top end of the power-transmitting section of the tubing string below the first isolator sub, where the power source generates power comprising at least 1 VA. The system can further include a second isolator sub mechanically coupled to the tubing string and positioned between the bottom neutral section and the power-transmitting section of the tubing string, where the second isolator sub has the second cavity running therethrough, and where the second isolator sub electrically separates the casing from the tubing string and the bottom neutral section from the power-transmitting section. The system can also include an electrical device disposed within the wellbore below the second isolator sub and electrically coupled to a bottom end of the power-transmitting section of the tubing string.

In another aspect, the disclosure can generally relate to an isolator sub disposed between casing walls in a wellbore of a subterranean formation. The isolator sub can include an outer case having an electrically conductive material, a first aperture that traverses a top end of the outer case, and a second aperture that traverses a bottom end of the outer case. The isolator sub can also include an inner wall disposed within the outer case and forming a cavity therethrough, where the cavity is bounded by the first aperture and the second aperture, where the inner wall is mechanically coupled to a neutral portion of a tubing string at the top end and to a power-transmitting portion of the tubing string at the bottom end. The isolator sub can further include an insulating material disposed between the outer case and the inner wall, where the insulating material is electrically nonconductive, is impervious to fluids and gases, and can withstand temperatures in excess of 600° F. The insulating material can surround a portion of the power-transmitting portion of the tubing string. The power-transmitting portion of the tubing string can be electrically coupled to a power source and can be disposed between the casing walls in the wellbore.

In yet another aspect, the disclosure can generally relate to an isolator sub disposed between casing walls in a wellbore of a subterranean formation. The isolator sub can include an outer case having an electrically conductive material, a first aperture that traverses a bottom end of the outer case, and a second aperture that traverses a top end of the outer case. The isolator sub can also include an inner wall disposed within the outer case and forming a cavity therethrough, where the cavity is bounded by the first aperture and the second aperture, where the inner wall is mechanically coupled to a neutral portion of a tubing string at the bottom end and to a power-transmitting portion of the tubing string at the top end. The isolator sub can further include an insulating material disposed between the outer case and the inner wall, where the insulating material is electrically nonconductive, is impervious to fluids and gases, and can withstand temperatures in excess of 600° F. The insulating material can surround a portion of the power-transmitting portion of the tubing string. The power-transmitting portion of the tubing string can be electrically coupled to a power source and can be disposed between the casing walls in the wellbore.

These and other aspects, objects, features, and embodiments will be apparent from the following description and the appended claims.

BRIEF DESCRIPTION OF THE DRAWINGS

The drawings illustrate only example embodiments of methods, systems, and devices for transmitting power within a wellbore (also called herein a "borehole") and are therefore not to be considered limiting of its scope, as transmitting power within a wellbore may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
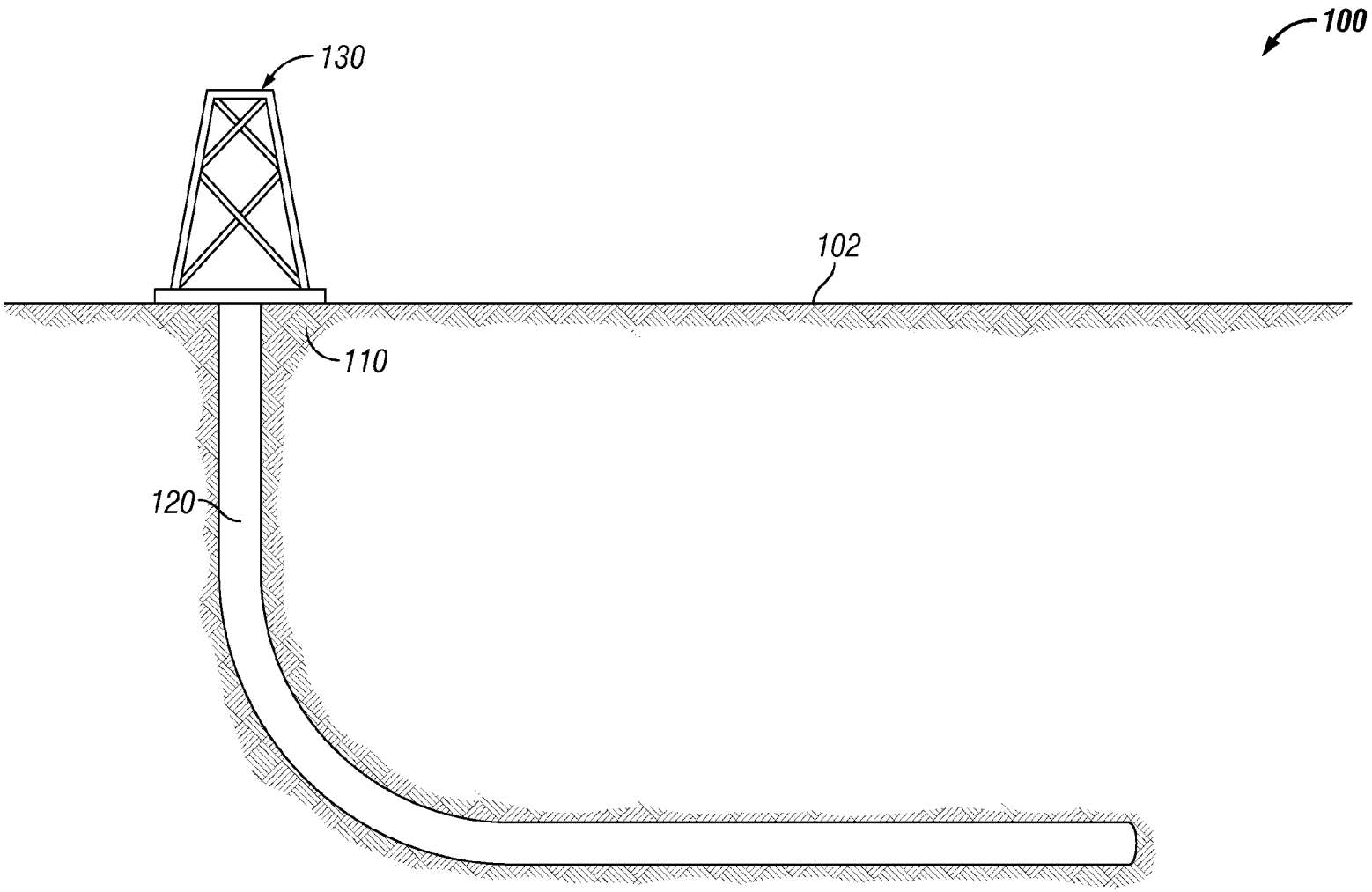
FIG. 1 shows a schematic diagram of a field system that can transmit power within a subterranean wellbore in accordance with certain example embodiments.

Example embodiments directed to transmitting power within a subterranean wellbore will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and a height can each generally be described as lateral directions.

In certain embodiments, it is necessary to consider the balance of voltage versus current for a given power requirement within the wellbore. A higher voltage and lower current density may be required. High voltage may impact the insulation systems, while high current may impact resistive losses, causing undesirable electric etching and heating in the interfaces or conductors. In some example embodiments, a significant effort can be made to operate the system voltage as high as possible to reduce the system current to a level that is as low as possible. High system current may result in a voltage gradient from wellhead to casing end on the outer surface of the casing, which is undesirable. However, it is recognized that many different voltage, amperage, and power requirements could be used with example embodiments, and that example embodiments are not limited to any particular voltage, amperage, or power values.

The case for higher system voltage (i.e., lower current) has advantages in certain example embodiments. An isolator sub (described below) is an insulating short joint section, one of which can be located near the wellhead, that allows a break in metallic or conductor connection between its two ends. This allows the string tubing below the isolator sub to be electrically insulated from the string tubing above the isolator sub. If another isolator sub is placed at the bottom of the tubing string in the wellbore, a portion of tubing string (the power-transmitting section of the tubing string, as defined below in FIG. 2) can be excited electrically to carry current to an electrical device (i.e., a pump, a motor) positioned within the wellbore. Example embodiments described herein provide not only inductive isolation of the voltage-transmitting section of the tubing string, but also dielectric isolation. Thus, systems using example embodiments can deliver higher voltages and/or currents to an electrical device within a wellbore.

A user as described herein may be any person that is involved with a piping system in a subterranean wellbore and/or transmitting power within the subterranean wellbore for a field system. Examples of a user may include, but are not limited to, a roughneck, a company representative, a drilling engineer, a tool pusher, a service hand, a field engineer, an electrician, a mechanic, an operator, a consultant, a contractor, and a manufacturer's representative.

FIG. 1 shows a schematic diagram of a field system 100 that can transmit power within a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., extract downhole materials) the wellbore 120. The field equipment 130 can be positioned and/or assembled at the surface 102. The field equipment 130 can include, but is not limited to, a derrick, a tool pusher, a clamp, a tong, drill pipe, a drill bit, example isolator subs, tubing pipe, a power source, and casing pipe. The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of a casing pipe to be inserted at a certain depth in the wellbore 120.

Figure 2:
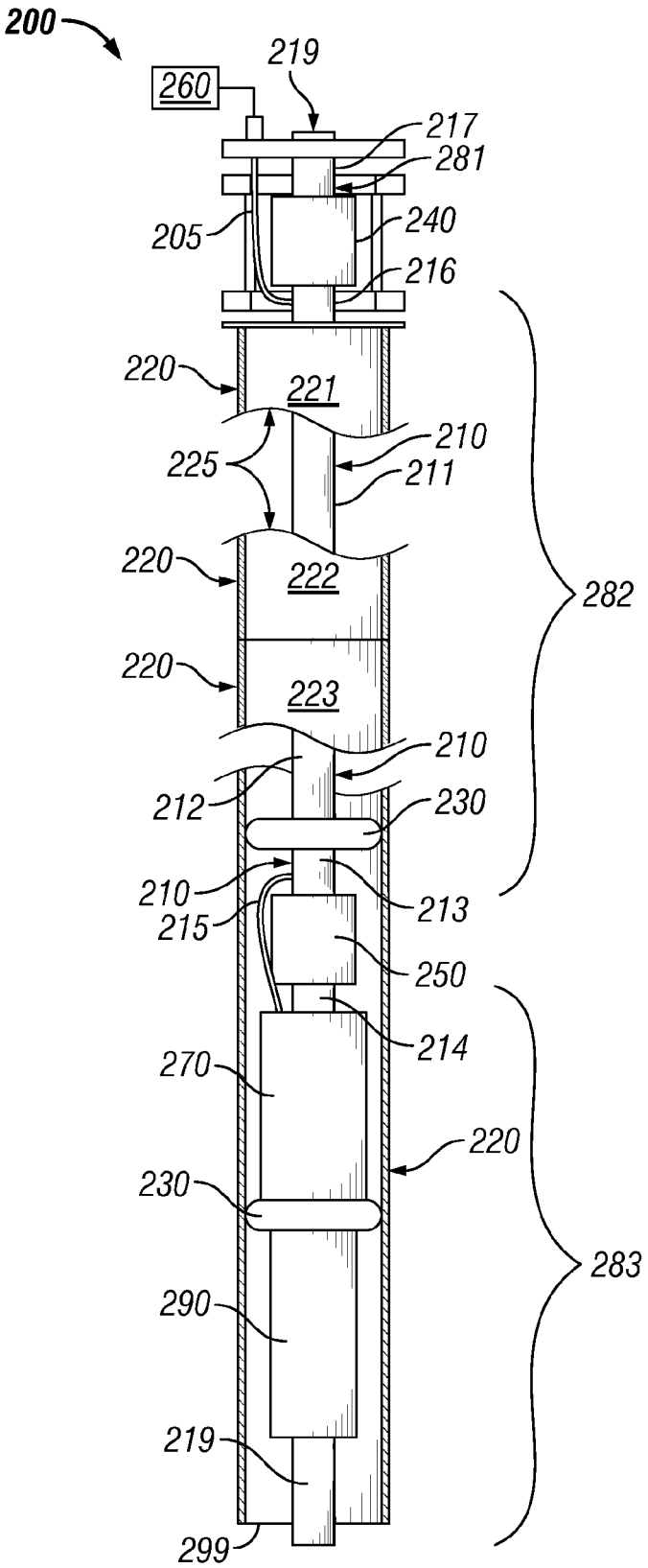
FIG. 2 shows a side view in partial cross section of a piping system within a wellbore of a field system in accordance with certain example embodiments.

FIG. 2 shows a side view in partial cross section of a piping system 200 within a wellbore of a field system in accordance with certain example embodiments. In one or more embodiments, one or more of the features shown in FIG. 2 may be omitted, added, repeated, and/or substituted. Accordingly, embodiments of a piping system should not be considered limited to the specific arrangements of components shown in FIG. 2.

The piping system 200 comprises a casing 220, a tubing string 210, a power source 260, a top isolator sub 240, a bottom isolator sub 250, a power conditioner 270, an electrical device 290, and a number of centralizers 230, and a conductive interface 299. Referring to FIGS. 1 and 2, the casing 220 includes a number of casing pipes (e.g., casing pipe 221, casing pipe 222, casing pipe 223) that are mechanically coupled to each other end-to-end, usually with mating threads. The casing pipes of the casing 220 can be mechanically coupled to each other directly or using a coupling device, such as a coupling sleeve.

Each casing pipe of the casing 220 can have a length and a width (e.g., outer diameter). The length of a casing pipe can vary. For example, a common length of a casing pipe is approximately 40 feet. The length of a casing pipe can be longer (e.g., 60 feet) or shorter (e.g., 10 feet) than 40 feet. The width of a casing pipe can also vary and can depend on the cross-sectional shape of the casing pipe. For example, when the cross-sectional shape of the casing pipe is circular, the width can refer to an outer diameter, an inner diameter, or some other form of measurement of the casing pipe. Examples of a width in terms of an outer diameter can include, but are not limited to, 7 inches, 7-⅝ inches, 8-⅝ inches, 10-¾ inches, 13-⅜ inches, and 14 inches.

The size (e.g., width, length) of the casing 220 is determined based on the information gathered using field equipment 130 with respect to the wellbore 120. The walls of the casing 220 have an inner surface that forms a cavity 225 that traverses the length of the casing 220. The casing 220 can be made of one or more of a number of suitable materials, including but not limited to steel. In certain example embodiments, the casing 220 is made of an electrically conductive material. The casing 220 can have, at least along an inner surface, a coating of one or more of a number of electrically non-conductive materials. The thickness of such a coating can vary, depending on one or more of a number of factors, such as the imbalance in current density between the tubing string 210 and the casing 220 that must be overcome to maintain the electric circuit.

The tubing string 210 includes a number of tubing pipes (e.g., tubing pipe 211, tubing pipe 212, tubing pipe 213, tubing pipe 214, tubing pipe 219, tubing pipe 216, tubing pipe 217) that are mechanically coupled to each other end-to-end, usually with mating threads. The tubing pipes of the tubing string 210 can be mechanically coupled to each other directly or using a coupling device, such as a coupling sleeve or an example isolator sub (e.g., top isolator sub 240, bottom isolator sub 250), described below. In some cases, more than one tubing string can be disposed within a cavity 225 of the casing 220.

Each tubing pipe of the tubing string 210 can have a length and a width (e.g., outer diameter). The length of a tubing pipe can vary. For example, a common length of a tubing pipe is approximately 30 feet. The length of a tubing pipe can be longer (e.g., 40 feet) or shorter (e.g., 10 feet) than 30 feet. The width of a tubing pipe can also vary and can depend on one or more of a number of factors, including but not limited to the inner diameter of the casing pipe. For example, the width of the tubing pipe is less than the inner diameter of the casing pipe. The width of a tubing pipe can refer to an outer diameter, an inner diameter, or some other form of measurement of the tubing pipe. Examples of a width in terms of an outer diameter can include, but are not limited to, 7 inches, 5 inches, and 4 inches.

Two tubing pipes (e.g., tubing pipe 216 and tubing pipe 217, tubing pipe 213 and tubing pipe 214) of the tubing string 210 can be mechanically coupled to each other using an isolator sub (e.g., top isolator sub 240, bottom isolator sub 250, respectively). In such a case, the tubing string 210 can be divided into segments. For example, as shown in FIG. 2, the portion (e.g., tubing pipe 217) of the tubing string 210 located above the top isolator sub 240 can be called the top neutral section 281, and the portion (e.g., tubing pipe 214, tubing pipe 219) of the tubing string 210 located below the bottom isolator sub 250 can be called the bottom neutral section 283. As another example, the portion (e.g., tubing pipe 211, tubing pipe 212, tubing pipe 213) of the tubing string 210 located between the top isolator sub 240 and the bottom isolator sub 250 can be called the power-transmitting section 282.

The size (e.g., outer diameter, length) of the tubing string 210 is determined based, in part, on the size of the cavity 225 within the casing 220. The walls of the tubing string 210 have an inner surface that forms a cavity 219 that traverses the length of the tubing string 210. The tubing string 210 can be made of one or more of a number of suitable materials, including but not limited to steel. The one or more materials of the tubing string 210 can be the same or different than the materials of the casing 220. In certain example embodiments, the tubing string 210 is made of an electrically conductive material. However, the tubing string 210 should not "electrically" contact the casing 220, so that the circuit is maintained. The tubing string 210 can have, at least along an outer surface, a coating of one or more of a number of electrically non-conductive materials. In such a case, the coating of an electrically insulating material can be thick and rugged so as to complete the 'insulation' system for the necessary voltage requirement of a given application.

The power source 260 can be any device (e.g., generator, battery) capable of generating electric power that can be used to operate the electrical device 290, described below. In certain example embodiments, the power source 260 is electrically coupled to the tubing string 210. Specifically, the power source 260 can be coupled to a portion of the power-transmitting section 282 of the tubing string. The power source 260 can be electrically coupled to the tubing string 210 wirelessly and/or using one or more electrical conductors (e.g., a cable). For example, as shown in FIG. 2, cable 205 can be used to electrically couple the power source 260 to the top end of the power-transmitting section 282 of the tubing string 210. In certain example embodiments, cable 205 is capable of maintaining a high current density connection between the power source 260 and the power-transmitting section 282 of the tubing string 210. In certain example embodiments, high current densities are needed when higher voltages cannot be accommodated safely or reliably.

As an example, in 10,000 foot wellbore 120, the total string (tubing string 210 and casing 220) resistance can be approximately 3 Ohms. If the current that is required by the electrical device 290 is 100 amperes, then the power source 260 must provide 300 volts ($100\ A \times 3\Omega = 300\ V$) above that used by the electrical device 290. The reason that an extra 300 V is needed is because the 300 V is lost to the tubing string 210 and the casing 220, and so the electrical device 290 does not receive the 300 V. In view of these losses caused by the tubing string 210 and the casing 220, an electrical device 290 using a high (e.g., 1000 A) amount of amperage may be beyond a practical application as the voltage loss (e.g., 3000V) through the tubing string 210 and the casing 220 may exceed practical electrical and/or hardware configurations.

The power generated by the power source 260 can be alternating current (AC) power or direct current (DC) power. If the power generated by the power source 260 is AC power, the power can be delivered in one phase. The power generated by the power source 260 can be conditioned (e.g., transformed, inverted, converted) by a power conditioner (not shown in FIG. 2, but similar to the power conditioner 270 described below) before being delivered to the tubing string 210. In certain example embodiments, one pole (e.g., the "hot" leg of a single phase AC current) of the power generated by the power source 260 can be electrically coupled to the tubing string 210, while another pole (e.g., the neutral leg of a single phase AC current) can be electrically coupled to the casing 220. In such a case, a complete circuit can be created between the tubing string 210 and the casing 220, using other components of the piping system 200 described below.

In certain example embodiments, the top isolator sub 240 is positioned between, and mechanically coupled to, the top neutral section 281 of the tubing string 210 and the power-transmitting section 282 of the tubing string 210. In such a case, the top isolator sub 240 electrically isolates (or electrically separates) the top neutral section 281 of the tubing string 210 from the power-transmitting section 282 of the tubing string 210. In addition, the top isolator sub 240 can electrically isolate the casing 220 from the tubing string 210. An amount of voltage and/or current generated by the power source 260 (described below) can, in part, determine the size and/or features of the top isolation sub 240 that is used for a given application.

In certain example embodiments, the top isolator sub 240 has a cavity that traverses therethrough. In such a case, the cavity of the top isolator sub 240 can be substantially the same size as the cavity 219 of the tubing string 210. Thus, when the top isolator sub 240 is positioned between and mechanically coupled to the top neutral section 281 of the tubing string 210 and the power-transmitting section 282 of the tubing string 210, a continuous passage traverses therethrough. Details of the top isolator sub 240 are described below with respect to FIGS. 3 and 5A-5C.

Similarly, in certain example embodiments, the bottom isolator sub 250 is positioned between, and mechanically coupled to, the bottom neutral section 283 of the tubing string 210 and the power-transmitting section 282 of the tubing string 210. In such a case, the bottom isolator sub 250 electrically isolates the bottom neutral section 283 of the tubing string 210 from the power-transmitting section 282 of the tubing string 210. In addition, the bottom isolator sub 250 can electrically isolate the casing 220 from the tubing string 210. An amount of voltage and/or current generated by the power source 260 (described below) can, in part, determine the size and/or features of the bottom isolation sub 250 that is used for a given application. Other factors that can affect the size and/or features of the bottom isolation sub 250 can include, but are not limited to, the length of the power-transmitting section 282, the size (e.g., inner diameter, outer diameter) of the tubing string 210, and the material of the tubing string 210.

As with the top isolator sub 240, the bottom isolator sub 250 has a cavity that traverses therethrough. In such a case, the cavity of the bottom isolator sub 250 can be substantially the same size as the cavity 219 of the tubing string 210. Thus, when the bottom isolator sub 250 is positioned between and mechanically coupled to the bottom neutral section 283 of the tubing string 210 and the power-transmitting section 282 of the tubing string 210, a continuous passage traverses therethrough. Electrically, in certain example embodiments, an isolator sub (e.g., top isolator sub 240, bottom isolator sub 250) behaves like a dielectric break in an otherwise solid piece of the power-transmission section of the tubing string 210. In actual practice, such an isolator sub fits within the cavity 225 of the casing 220 with sufficient clearance from the walls of the casing 220, exhibits low end-to-end capacitance, and is able to standoff many hundreds of volts of applied potential.

In accordance with example embodiments, a technique for electrical isolation includes a ceramic and/or other electrically non-conductive insulator inserted in series with tubing pipes of the tubing string 210. This may be, for example, built-in to a section of pipe that is relatively short (e.g., 4 foot section) relative to the length of a tubing pipe. The word "sub" for the isolator subs described herein is used to designate that the length of an isolator sub, having such electrically non-conductive properties, can be of relatively short length. The ceramic and portions of the tubing string 210 may be clamped together and can be connected without creating an electrical short in the tubing string 210. An insulating coating may be applied to the internal and external surfaces of the tubing string 210 and/or the shell of the isolator sub as electrical breakdown protection across the gap between the tubing string 210 and the shell of the isolator sub.

In an example, a field test of an isolation sub called a "Gapsub" was conducted where approximately 300 $V_{rms}$ and 75 A was applied to the tubing string 210. In this case, the piping system 200 could support an electrical device 290 (described below) with a 15 horsepower (HP) rating at a depth within the wellbore 120 of approximately 1000 feet. In this example, approximately 350 $V_{rms}$ was generated by the power source 260 and delivered to the tubing string 210 so that approximately 300 $V_{rms}$ was delivered to the electrical device 290. The electrical device 290 in this case was a pump, and the pump, receiving power using an example embodiment, delivered field resources from the subterranean formation 110. Field applications at greater depths (e.g., 10,000 feet) using example embodiments can require higher voltages (e.g., 1200 $V_{rms}$, 2500 $V_{rms}$) generated by the power source 260.

An isolator sub (e.g., top isolator sub 240, bottom isolator sub 250) is capable of withstanding one or more of a number of environmental conditions in the wellbore 120. In addition to supporting the weight of the remainder of the downhole portion of the piping system 200 (which is a critical aspect of the top isolator sub 240 because the top isolator sub 240 is positioned at the top end of the tubing string 210), as described above, an isolator sub can resist torque, torsion, bending, and/or any other force that could impact the mechanical integrity of the isolator sub. These latter characteristics are important for the bottom isolator sub 250, which is mechanically coupled to the bottom neutral section 283 of the tubing string 210 and then gradually inserted further into the wellbore 120 as the various tubing pipes of the power-transmitting section 282 of the tubing string 210 is made up (mechanically coupled to each other, commonly using mating threads and thus a rotational motion).

The isolator sub can also be equipped (for example, with a number of sealing members, as described below with respect to FIGS. 5A-5C) to be impervious to fluids and/or gases within the cavity 225 of the casing 220. Such fluids and gases are one or more of a number of fluids and gases found within the wellbore 120 of the subterranean formation 110. Further, the isolator sub can withstand temperatures in excess of 600° F. or 750° F. For example, within a wellbore, it is not uncommon to encounter steam in excess of 600° F., and so each isolator sub can be able to sustain operation and mechanical integrity while being exposed to such temperatures.

The optional power conditioner 270 can be disposed within the cavity 225 of the casing 220 proximate to the bottom isolator sub 250. For example, as shown in FIG. 2, the power conditioner 270 can be located below the bottom isolator sub 250. The power conditioner 270 can also be disposed outside of and/or integral with the tubing string 210. In such a case, the power conditioner 270 can have a feature substantially similar to the top isolator sub 240 and the bottom isolator sub 250 in that the power conditioner 270 can have a cavity that traverses therethrough. In such a case, the cavity of the power conditioner 270 can be substantially the same size as the cavity 219 of the tubing string 210. Thus, when the power conditioner 270 is positioned between and mechanically coupled to portions (e.g., tubing pipe 214, tubing pipe 219) of the bottom neutral section 283 of the tubing string 210, a continuous passage traverses therethrough.

In certain example embodiments, the power conditioner 270 is electrically coupled to the tubing string 210. Specifically, the power conditioner 270 can be coupled to a portion of the power-transmitting section 282 of the tubing string 210. The power conditioner 270 can be electrically coupled to the tubing string 210, for example, using one or more electrical conductors (e.g., a cable). For example, as shown in FIG. 2, cable 215 can be used to electrically couple the power conditioner 270 to the bottom end of the power-transmitting section 282 of the tubing string 210. In certain example embodiments, cable 215 is capable of maintaining a high current connection between the power conditioner 270 and the power-transmitting section 282 of the tubing string 210.

The power received by the power conditioner 270 can be the same type of power (e.g., AC power, DC power) generated by the power source 260. The power received by the power conditioner 270 can be conditioned (e.g., transformed, inverted, converted) into any level and/or form required by the electrical device 290 before being delivered to the electrical device 290. For example, if the power conditioner 270 receives single phase AC power, the power conditioner 270 can generate 120V three phase AC power, which is sent to the electrical device 290. As described herein the power conditioned by the power conditioner 270 can be called conditioned power.

The electrical device 290 is electrically coupled to the power conditioner 270 or, if there is no power conditioner 270, to the power-transmitting section 282 of the tubing string 210. The electrical device 290 uses electric power (conditioned by the power conditioner 270) to operate and perform one or more functions within the wellbore 120. Examples of the electrical device 290 can include, but are not limited to, a motorized valve, a boiler, and a pump. For example, the electrical device 290 can be a pump assembly (e.g., pump, pump motor) that can pump, when operating, oil, gas, and/or production fluids from the wellbore 120 to the surface 102. The electrical device 290 can include a control system that controls the functionality of the electrical device 290. Such a control system can be communicably coupled with a user and/or some other system so that the control system can receive and/or send commands and/or data.

In certain example embodiments, a conductive interface 299 is disposed below the bottom isolator sub 250 within the cavity of the casing 220. The conductive interface 299 can be electrically coupled to the electrical device 290. In such a case, the conductive interface 299 electrically couples the casing 220 to the tubing string 210. Thus, the casing 220 can be used as a return leg to complete the electric circuit that starts at the power source 260. The conductive interface 299 can be made of one or more of a number of electrically conductive materials. The conductive interface 299 can be a packer, a seal, an anchor assembly, or any other suitable device that can be placed within the wellbore 120.

A conventional interface at the conductive interface 299 may employ a design that ensures conductivity for the circuit. In certain example embodiments, the conductive interface 299 includes metallic (or otherwise electrically conductive) "teeth" that expand out to the casing 220 to anchor and seal the production area within the cavity 225. The anchoring or locating 'teeth' can establish the electrical current path, and special robust designs can be used in the practice of this invention.

Centralizing the tubing string 210 within the cavity 225 of the casing 210 may be a mechanical and/or electrical requirement for the operational use of example embodiments. A number of centralizers 230 can be disposed at various locations throughout the cavity 225 of the casing 220 between the casing 220 and the tubing string 210. In certain example embodiments, each centralizer 230 contacts both the outer surface of the tubing string 210 and the inner surface of the casing 220. Each centralizer 230 can have robust electrical insulation to prevent arc paths between the tubing string 210 and the casing 220.

Each centralizer 230 can be the same and/or different from the other centralizers 230 in the piping system 200. A centralizer 230 can be made of and/or coated with one or more of a number of electrically non-conductive materials. Thus, each centralizer 230 can provide an electrical separation between the tubing string 210 and the casing 220. In certain example embodiments, the centralizer 230 can provide a physical barrier within the cavity 225 of the casing 220 between the casing 220 and the tubing string 210.

Thus, the electrical circuit formed by the power source 260, the power-transmitting section 282 of the tubing string 210, the power conditioner 270, the electrical device 290, the conductive interface 299, and the casing 220 is not altered by arcing that can result between the tubing string 210 and the casing 220. A centralizer 230 design that, over time, would have a minimized surface for collection of surface debris (e.g., dirt) also may be useful for long life of the piping system 200. A surface of a centralizer 230 with undesirable dirt collection could provide a path for undesirable voltage breakdown and inoperability of the piping system 200.

High voltage breakdown is typically a short term event (i.e. short term to failure). Long term (i.e. months or years) exposure of conducting systems to high currents may impact all interfaces across which current passes, including welded and threaded joints. Shoe and slip contact from an anchor/packer to the wall of the casing needs to be robust to preserve the desired electrical pathway and electrical conductivity.

Figure 3:
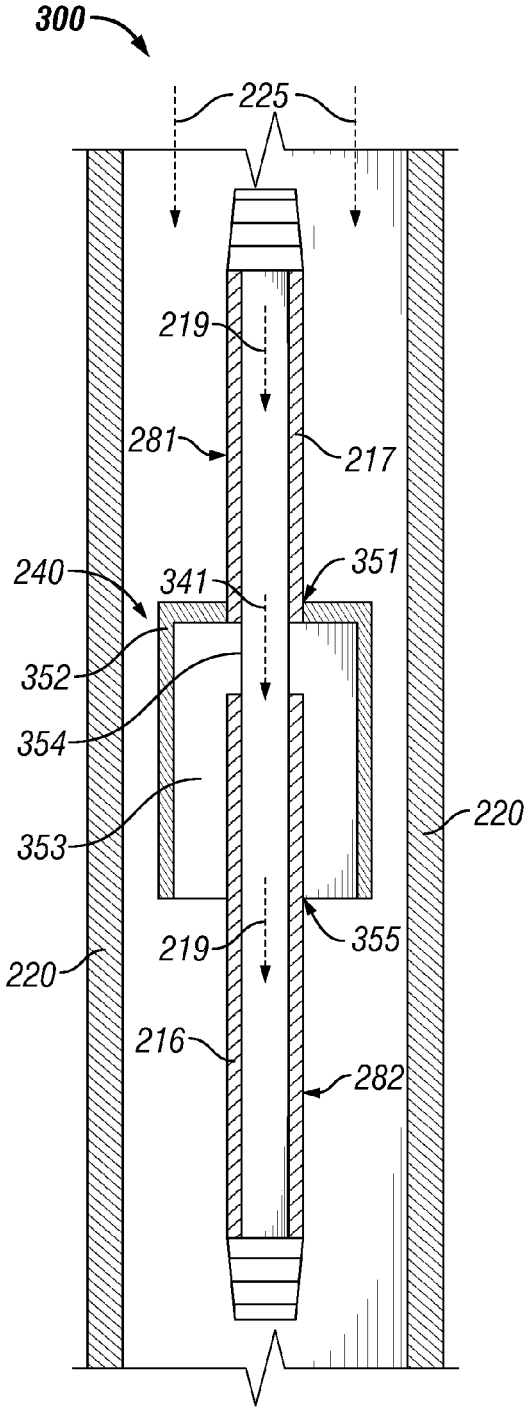
FIG. 3 shows a cross-sectional side view of a portion of a piping system in accordance with certain example embodiments.

FIG. 3 shows a cross-sectional side view of a portion 300 of the piping system 200 of FIG. 2 in accordance with certain example embodiments. Specifically, referring to FIGS. 1-3, FIG. 3 shows the bottom portion of the top neutral section 281 of the tubing string 210, the top isolator sub 240, and the top portion of the power-transmitting section 282 of the tubing string 210 of the piping system 200 of FIG. 2.

The cross-sectional view of FIG. 3 provides a detailed view of how, in certain example embodiments, the bottom portion of the top neutral section 281 of the tubing string 210 and the top portion of the power-transmitting section 282 of the tubing string 210 mechanically couple to the top isolator sub 240. In this example, the top isolator sub 240 has a shell 352 (also sometimes called a housing) that mechanically (e.g., threadably) couples to the bottom portion (in this case, tubing pipe 217) of the top neutral section 281 of the tubing string 210. In such a case, the shell 352 can have an aperture 351 through its top portion that traverses the shell 352. The shell 352 can be made of one or more of a number of materials. Such materials can be electrically conductive (e.g., steel) and/or electrically non-conductive (e.g., ceramic).

In certain example embodiments, disposed between the walls of the shell 352 is an insulator 353. The insulator 353 can be made of one or more of a number of electrically non-conductive materials (e.g., ceramic, ketone, a polymer). The insulator 353 can have an aperture 355 that originates at the bottom portion of the insulator 353 and traverses some or all of the top isolator sub 240. To avoid a fault condition, the aperture 355 is sized large enough for voltage hold-off between shell 352 and the tubing pipe 216. The aperture 355 can also have and have one or more of a number of features (e.g., mating threads) to receive and mechanically couple to the top portion (in this example, tubing pipe 216) of the power-transmitting section 282 of the tubing string 210. The primary electrical function of the top isolator sub 240 is to insulate tubing pipe 216 from tubing pipe 217 while maintaining the necessary mechanical requirements.

In certain example embodiments, as shown in FIG. 3, an additional aperture 354 can be disposed within the insulator 353 between (and axially aligned with) the shell 352 and the aperture 355. In such a case, the aperture 354 can have a smaller width than the width of the aperture 351 and the aperture 355. For example, the aperture 351 and the aperture 355 can have a width that is substantially similar to the outer diameter of the tubing pipe 217 and the tubing pipe 216, respectively, where the aperture 354 can have a width that is substantially the same as the inner diameter of the tubing pipe 217 and/or the tubing pipe 216. Thus, the cavity 341 formed by the aperture 354 in the insulator 353 can have substantially the same size (e.g., width, circumference) as the size of the cavity 219 formed by the inner diameter of the tubing pipe 217 and/or the tubing pipe 216. In certain example embodiments, the shell 352 can have an open end at the bottom side of the top isolator sub 240. In such a case, a portion of the insulator 353 can be exposed to the cavity 225 of the casing 220.

In certain example embodiments, the bottom isolator sub 250 can be oriented in an inverse (e.g., upside-down) fashion relative to the top isolator sub 240. For example, the shell of the bottom isolator sub 250 can be mechanically (e.g., threadably) coupled to the top portion of the bottom neutral section 283 of the tubing string 210. Further, the insulator of the bottom isolator sub 250 can have an aperture that originates at the top portion of the insulator and traverses some or all of the bottom isolator sub 250. Such an aperture can be sized and have one or more of a number of features (e.g., mating threads) to receive and mechanically couple to the bottom portion of the power-transmitting section 282 of the tubing string 210. Further, an additional aperture can be disposed within the insulator between (and axially aligned with) the shell and the aperture of the bottom isolator sub 250.

Figure 4:
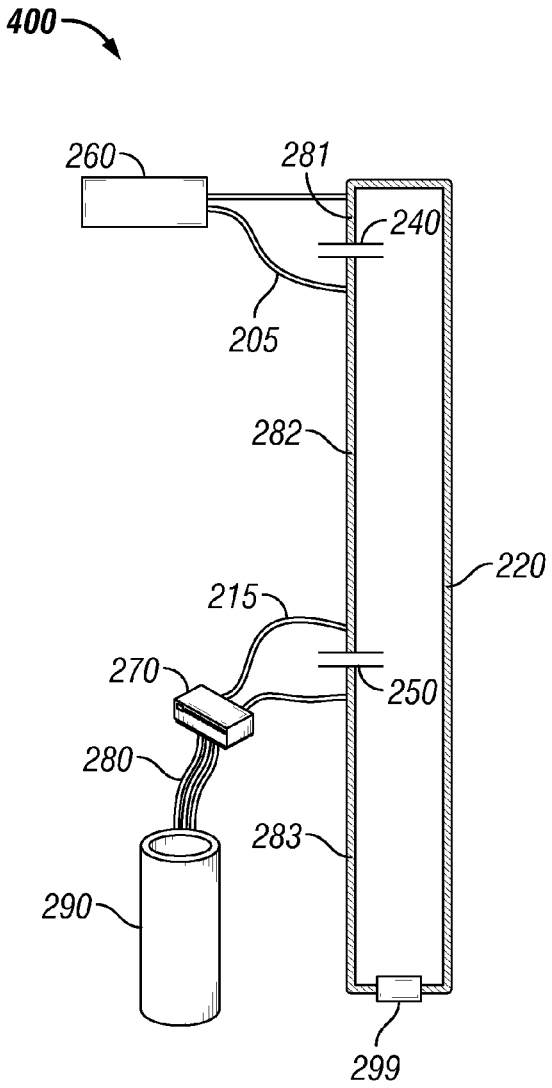
FIG. 4 shows an electrical schematic of an example piping system within a wellbore of a field in accordance with certain example embodiments.

FIG. 4 shows an electrical schematic 400 of the example piping system of FIG. 2, in accordance with certain example embodiments. Referring to FIGS. 1-4, the principal circuit in FIG. 4 originates with the power source 260, which sends power, using the cable 205, to the top portion of the power-transmitting section 282 of the tubing string 210, located just below the top isolator sub 240. The top isolator sub 240 can create a dielectric, physical break between the top neutral section 281 and the power-transmitting section 282 of the tubing string 210. The power then is transmitted down the power-transmitting section 282 of the tubing string 210 to the cable 215, which feeds the power to the power conditioner 270. The cable 215 is located just above the bottom isolator sub 250. In other words, the bottom isolator sub 250 creates a dielectric, physical break between the bottom neutral section 283 and the power-transmitting section 282 of the tubing string 210. The power conditioner 270 can send power (or a portion thereof, such as a neutral leg), using cable 417, to the bottom neutral section 283 of the casing string 210.

The conductive interface 299 can provide an electrical bridge between the bottom neutral section 283 of the tubing string 210 and the casing 220. The casing acts as an electrical ground and can be electrically coupled to the power source 260 to complete the primary circuit. A secondary circuit is also created by the power conditioner 270 by generating and sending conditioned power, using cable 280, to the electrical device 290. The power transmitted in the primary circuit of FIG. 4 can be single phase AC power, while the power used in the secondary circuit of FIG. 4 can be three-phase AC power.

Figure 5A:
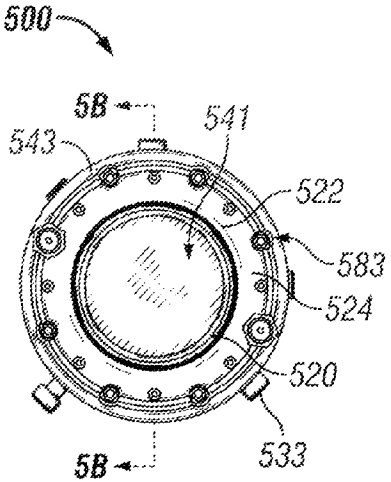
FIGS. 5A-5C show various views of an example isolator sub in accordance with one or more example embodiments.
Figure 5C:
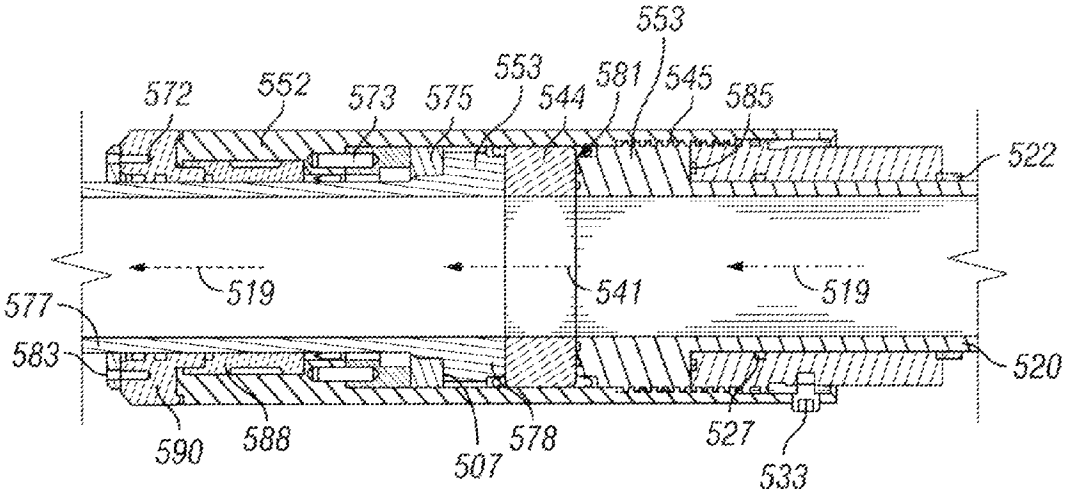
Figure 5B:
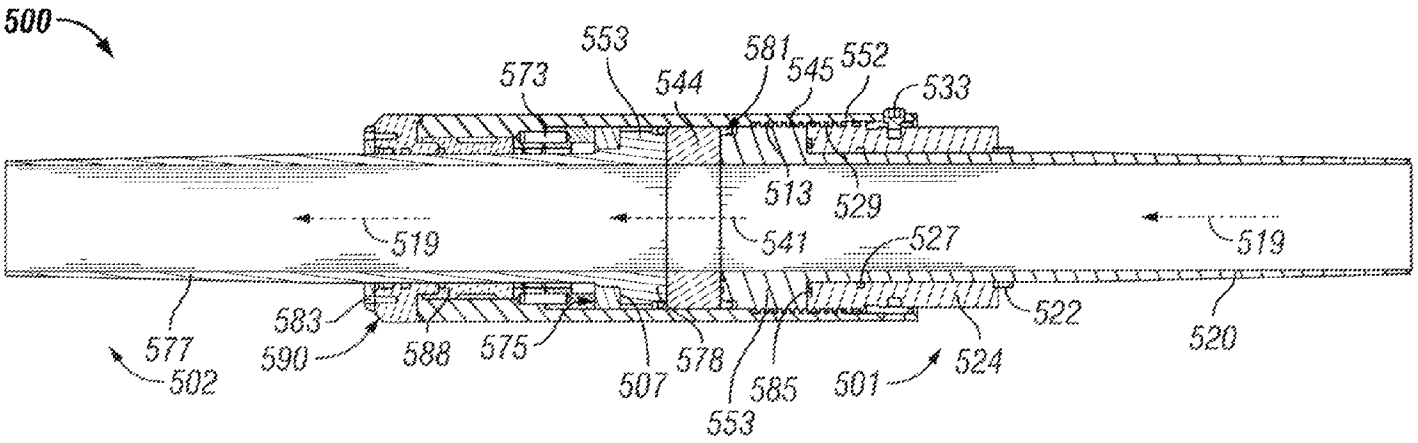

FIGS. 5A-5C show various views of an isolator sub 500 in accordance with one or more example embodiments. Specifically, FIG. 5A shows a top view of the isolator sub 500, and FIGS. 5B and 5C each shows a cross-sectional side view of the isolator sub 500. The isolator sub 500 of FIGS. 5A-5C has a different design than the isolator sub shown in FIG. 3. Here, the isolator sub 500 can be a top isolator sub and/or a bottom isolator sub. In one or more embodiments, one or more of the features shown in FIGS. 5A-5C may be omitted, added, repeated, and/or substituted. Accordingly, embodiments of an isolator sub should not be considered limited to the specific arrangements of components shown in FIGS. 5A-5C.

Referring now to FIGS. 1-5C, the example isolator sub 500 can be mechanically coupled (e.g., threadably, slotably, using fastening devices) to two tubing pipes, one on each end of the isolator sub 500. As discussed above with respect to FIG. 3, the isolator sub 500 can include a shell 552 and an insulator 553. The shell 552 and the insulator 553 can be coupled to each other in one or more of a number of ways. For example, as shown on the right side of FIGS. 5B and 5C, and insulator 553 can include threads 513 that threadably couple to threads 545 disposed on an inner surface 529 of the shell 552 of the isolator sub 500. As another example, as shown on the left side half of FIGS. 5B and 5C, the insulator 553 can be mechanically coupled to the shell 552 using one or more of a number of fastening devices (e.g., fastening devices 572, fastening devices 573, fastening devices 588, fastening devices 583) and other features (e.g., protrusion 507) to complement one or more features (e.g., collar 578) of the insulator 553 and/or the shell 552. In certain example embodiments, the fastening devices 572 are bolts, and the fastening devices 573 are pins.

In this example, the isolator sub 500 is disposed vertically within a cavity 225 of a casing 220 within a wellbore 120. As such, the isolator sub 500 can be capable of supporting weight (in the form of tubing string 210, one or more other isolator subs 250, a power conditioner 270, an electrical device 290, and/or any other component of the piping system 200) in excess of 100,000 pounds. Further, the isolator sub 500 can withstand extreme pressures (e.g., up to 10,000 pounds per square inch (psi)). In such a case, a number of sealing members (e.g., gaskets) can be disposed on various portions of the isolator sub 500. For example, as shown in FIGS. 5B and 5C, the isolator sub 500 can include sealing member 527, sealing member 522, sealing member 585, and sealing member 581 to prevent the ingress of fluids and gases up to a pressure of 10,000 psi.

The insulator 553 of the isolator sub 500 can include a number of pieces that are mechanically coupled to each other. For example, the insulator 553 of the isolator sub 500 of FIGS. 5A-5C can include member 577, central member 544, member 520, member 524, member 575, member 588, and member 590. Each member of the insulator 553 can mechanically couple to another member of the insulator 553 using one or more of a number of fastening features (e.g., fastening device, protrusion).

In certain example embodiments, the central member 544 of the insulator 553 physically separates an upper portion 501 from a lower portion 502 of the isolator sub 500. The thickness, material, and other characteristics of the central member 544 can vary to ensure that the power-transmitting section 282 of the tubing string 210 is electrically isolated from the top neutral section 281 of the tubing string 210 or the bottom neutral section 283 of the tubing string 210, as applicable. The central member 544 also includes an aperture 541 that traverses the central member 544. As described above with respect to FIG. 3, the aperture 541 can have a width that is substantially similar to the width of the sections of the tubing string 220 that mechanically couple to the isolator sub 500.

Further, the insulator 553 can have a cavity 519 on each side of the central member 544. In such a case, the cavity 519 is larger than the cavity 541 that traverses the central member 544. Specifically, as described above with respect to FIG. 3, the cavity 519 on each side of the central member 544 can have a width that is substantially the same as the inner diameter of the tubing pipe of the tubing string 210 that mechanically couples to the isolator sub 500.

The following description (in conjunction with FIGS. 1 through 5C) describes a few examples in accordance with one or more example embodiments. The examples are for transmitting power within a wellbore. Terminology used in FIGS. 1 through 5C is used in the provided examples without further reference to FIGS. 1 through 5C.

EXAMPLE 1

Consider the following example, which describes transmitting power within a wellbore in accordance with one or more example embodiments described above. The electrical device 290 in this case is a pump motor. Specifically, the pump motor is rated at 100 horsepower (HP) and requires 3-phase AC power of 500 volts at 300 amps. The 300 amps is generated by the power source 260, applied through the tubing string 210, conditioned by the power conditioner 270 (to create conditioned power), and delivered to the pump motor. The electric circuit is then complete when the power flows through the conductive interface 299 to the casing 220.

In such a case, the electrical pathway through the power-transmitting section 282 of the tubing string 210 and the casing 220 has an electrical resistance on the order of 3 ohms for 10,000 feet of length of the tubing string 210 and the casing 220 within the wellbore 120. Applying about 300 amps through 3 ohms results in about 1800 volts in the tubing string 210, which includes the voltage requirements of the pump motor. About 2300 volts (the sum of the loss through the power-transmitting section 282 of the tubing string 210 and the operating requirement of the pump motor) could be generated by the power source 260 and applied to the power-transmitting section 282 of the tubing string 210 to provide sufficient power to the pump motor. In other words, about one megawatt could be delivered by the power source 260 to the example piping system 200 to obtain approximately 300 kw of electrical power to the electrical device 290.

If the voltage requirement of the pump motor is about 2500 volts, then the current could be lowered to about 120 amps, and the loss in the power-transmitting section 282 of the tubing string 210 would be about 360 volts. In such a case, the power source 260 would need to generate about 2860 volts at 120 amps (344 kw) to operate the pump motor, where only 44 kw would be lost in transmitting the power through the power-transmitting section 282 of the tubing string 210, while the remaining approximately 300 kw would be used to operate the pump motor. With the latter example embodiment (where the power source 260 generates approximately 2500 volts), the piping system 200 requires better insulation (e.g., along the inner surfaces of the casing 220, along the outer surfaces of the power-transmitting section 282 of the tubing string 210) than what is required in the former example embodiment (i.e., the 500 volt system).

EXAMPLE 2

Consider another example, which describes transmitting power within a wellbore in accordance with one or more example embodiments described above. In this example embodiment, referring to FIGS. 1-5C, the electrical device 290 includes an electronics module and a 15 HP motor/pump unit. The power source 260 is a 180 kVA portable generator located at the surface 102 and rated at 240 VAC/300 A. The cable 205 that electrically couples the power source 260 to the power-transmitting section 282 of the tubing string 210 is a three conductor ESP (Electrical Submersible Pump) cable. Below the top isolator sub 240, an individual 240*v* circuit and ground were separated and attached to their respective contacts on the top isolator sub 240. The 240*v* "hot" side is attached to the lower contact of the top isolator sub 240, and the ground conductor is electrically coupled to the casing-grounded contact of the top isolator sub 240.

The power-transmitting section 282 of the tubing string 210 acts as the electrical conduit used to provide power to the electrical device, positioned below the bottom isolator sub 250. Electrically coupled to the bottom of the power-transmitting section 282 of the tubing string 210, just above the bottom isolator sub 250, is a cable 215 that includes three 100 foot conductors. One conductor is electrically coupled to the electronics module, another conductor is electrically coupled to the 15 HP motor/pump unit, and the third conductor is electrically coupled to ground. Between the motor/pump unit and the electronics module, a conductive interface 299 in the form of a torque anchor is electrically coupled to the casing 220 for a return ground path from the power-transmitting section 282 of the tubing string 210 to the casing 220 and back to the power source 260. The torque anchor also provides additional centralization of the tubing string 210 from the casing 220.

In this example, a plastic electrically non-conductive centralizer 230 is placed and secured at every coupling of two tubing pipes of the tubing string 210. The 15 HP motor/pump unit is rated to pump an 850 foot column of water. A sonic fluid test confirms that the fluid level in the wellbore 120 is 1087 feet below the surface 102. The power source 260 generates and delivers to the power-transmitting section 282 of the tubing string 210 a voltage of 240 VAC with a 60-70 ampere draw. After running the power source 260 for 15 minutes, the power source 260 is turned off. With the power source 260 off, the surface cable is disconnected and an additional sonic fluid test is conducted. The subsequent sonic fluid test indicates a fluid level at approximately 310 ft. below the surface 102. To further confirm pumped fluid, as the tubing string 210 is being pulled out of the wellbore 120, a calculation is performed at the 11th-12th tubing joint (each joint is approximately 30 feet long), and a confirmation is made that the motor/pump unit performed as expected. This indicates that conditioned power delivered to the motor/pump unit is sufficient for rated operation of the motor/pump unit using an example embodiment.

The systems, methods, and apparatuses described herein allow for transmitting power within a wellbore. Major components in such a configuration may include conventional oil production tubing pipe, conventional oilfield production casing pipe, multiple example isolator subs, and insulation systems. Such insulation systems may be designed to insulate the tubing string from the casing at each end of the wellbore. Further, there may be a conductive interface (e.g., anchor, packer assembly) that may provide electrical conductive contact from the production tubing to the casing, providing a return circuit toward the end of the tubing string.

Using example embodiments described herein, it is possible to use the existing metallic (or otherwise electrically conductive) structure of the constructed well as the electrical conductor set to supply energy for moderate to high power equipment that is located within a wellbore. For example, example embodiments may be employed to supply power of 100 KVA-1 MVA to an electrical device, although less or more power could be employed. Supply of power using existing wellbore hardware, such as a tubing string and casing, may reduce or eliminate the need for conventional power cabling completion insertions. The application of example embodiments may employ relatively high current and moderately high voltage use of the well structure.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

We claim:

1. A system for applying power into a wellbore within a subterranean formation, the system comprising:

a tubing string comprising a plurality of electrically conductive tubing pipes mechanically coupled end-to-end, wherein the tubing string comprises a top neutral section positioned proximate to an entry point of the wellbore and a power-transmitting section positioned below the top neutral section in the wellbore, and wherein the tubing string has a first cavity running therethrough;

a first isolator sub mechanically coupled to and positioned between the neutral section and the power-transmitting section of the tubing string, wherein the first isolator sub has the first cavity running therethrough, wherein the first isolator sub electrically separates the top neutral section from the power-transmitting section, and wherein the first isolator sub is configured to isolate direct current (DC) power and alternating current (AC) power from the top neutral section;

a second isolator sub mechanically coupled to the tubing string, wherein the tubing string further comprises a bottom neutral section positioned toward a distal end of the wellbore, wherein the second isolator sub is positioned between the bottom neutral section and the power-transmitting section of the tubing string, wherein the second isolator sub has the first cavity running therethrough, wherein the second isolator sub electrically separates the bottom neutral section from the power-transmitting section, and wherein the second isolator sub is configured to isolate the DC power and the AC power from the bottom neutral section;

a power source positioned above the entry point and electrically coupled to a top end of the power-transmitting section of the tubing string below the first isolator sub; and an electrical device disposed within the wellbore and electrically coupled to the power-transmitting section of the tubing string above the second isolator sub.

2. The system of claim 1, further comprising:

a power conditioner electrically coupled between the power-transmitting section of the tubing string and the electrical device, wherein the power conditioner converts the power generated by the power source to conditioned power suitable for consumption by the electrical device.

3. The system of claim 2, wherein the power generated by the power source is single-phase AC power, and wherein the conditioned power is three-phase AC power.

4. The system of claim 1, wherein the electrical device, when operating, delivers a product through the first cavity beyond the entry point.

5. The system of claim 1, wherein the first isolator sub comprises material that can withstand temperatures above 600° F.

6. The system of claim 1, wherein the first isolator sub is impervious to fluids and gases.

7. The system of claim 1, wherein the first isolator sub comprises an insulator disposed within a shell of the first isolator sub, wherein the shell comprises electrically conductive material, and wherein the insulator comprises electrically non-conductive material and has a second cavity running therethrough.

8. The system of claim 7, wherein the shell is mechanically coupled to the top neutral section of the tubing string, and wherein the shell is mechanically isolated from the power-transmitting section of the tubing string.

9. The system of claim 7, wherein the insulating material comprises at least one selected from a group consisting of a ceramic material and a polymer.

10. The system of claim 1, wherein the electrical device is, at least in part, electrically coupled to the power-transmitting section of the tubing string using a cable capable of transmitting a high current density.

11. The system of claim 1, further comprising:

a casing disposed within the wellbore and comprising a plurality of electrically conductive casing pipes mechanically coupled end-to-end, wherein the casing has a second cavity running therethrough, wherein the tubing string is disposed within the second cavity without contacting the casing.

12. The system of claim 11, further comprising:

a conductive interface disposed below the second isolator sub within the second cavity, wherein the conductive interface electrically couples the casing and the tubing string.

13. The system of claim 12, wherein the conductive interface comprises at least one selected from a group consisting of a packer, an anchor assembly, and a seal.

14. The system of claim 11, wherein the casing is an electrical ground for an electric circuit that comprises power generated by the power source.

15. The system of claim 11, wherein the power source is further electrically coupled to the casing.

16. The system of claim 11, further comprising:

a plurality of centralizers disposed inside the second cavity between the power-transmitting section of the tubing string and an inner wall of the casing, wherein the plurality of centralizers are made of an electrically nonconductive material.

17. The system of claim 1, wherein the first isolator sub mechanically supports a weight in excess of 100,000 pounds, wherein the weight is comprised of the power-transmitting section of the tubing string, the bottom neutral section of the tubing string, and the second isolator sub.

18. An isolator sub disposed in a first cavity between casing walls in a wellbore of a subterranean formation, the isolator sub comprising:

an outer case comprising an electrically conductive material, a first aperture that traverses a top end of the outer case, and a second aperture that traverses a bottom end of the outer case;

an inner wall disposed within the outer case and forming a second cavity therethrough, wherein the second cavity is bounded by the first aperture and the second aperture, wherein the inner wall is mechanically coupled to a neutral portion of a tubing string adjacent to the top end of the outer case and to a power-transmitting portion of the tubing string adjacent to the bottom end of the outer case; and an insulating material disposed between the outer case and the inner wall, wherein the insulating material is electrically nonconductive, wherein the insulating material surrounds a portion of the power-transmitting portion of the tubing string, wherein the power-transmitting portion of the tubing string is electrically coupled to a power source and is disposed between the casing walls in the wellbore, wherein the outer case is configured to couple to the neutral portion of the tubing string at the first aperture, and wherein the second aperture of the outer case avoids contact with the tubing string.

19. An isolator sub disposed in a first cavity between casing walls in a wellbore of a subterranean formation, the isolator sub comprising:

an outer case comprising an electrically conductive material, a first aperture that traverses a bottom end of the outer case, and a second aperture that traverses a top end of the outer case;

an inner wall disposed within the outer case and forming a second cavity therethrough, wherein the second cavity is bounded by the first aperture and the second aperture, wherein the inner wall is mechanically coupled to a neutral portion of a tubing string adjacent to the bottom end of the outer case and to a power-transmitting portion of the tubing string adjacent to the top end of the outer case; and an insulating material disposed between the outer case and the inner wall, wherein the insulating material is electrically nonconductive, wherein the insulating material surrounds a portion of the power-transmitting portion of the tubing string, wherein the power-transmitting portion of the tubing string is electrically coupled to a power source and is disposed between the casing walls in the wellbore, wherein the outer case is configured to couple to the neutral portion of the tubing string at the first aperture, and wherein the second aperture of the outer case avoids contact with the tubing string.

* * * * *